US009227805B2

(12) United States Patent
Nishiyama

(10) Patent No.: US 9,227,805 B2
(45) Date of Patent: Jan. 5, 2016

(54) PRINTING APPARATUS, CONTROL METHOD THEREOF AND STORAGE MEDIUM STORING PROGRAM

(71) Applicant: CANON KABUSHIKI KAISHA, Tokyo (JP)

(72) Inventor: Kaori Nishiyama, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/294,055

(22) Filed: Jun. 2, 2014

(65) Prior Publication Data

US 2014/0265104 A1 Sep. 18, 2014

Related U.S. Application Data

(63) Continuation of application No. 13/674,868, filed on Nov. 12, 2012, now Pat. No. 8,777,207.

(30) Foreign Application Priority Data

Dec. 1, 2011 (JP) ..... 2011-264120

(51) Int. Cl.
*B65H 5/00* (2006.01)
*B65H 7/00* (2006.01)
(Continued)

(52) U.S. Cl.
CPC ..... *B65H 7/00* (2013.01); *B41J 11/008* (2013.01); *B41J 13/12* (2013.01); *B65H 2301/1422* (2013.01); *B65H 2701/1916* (2013.01)

(58) Field of Classification Search
CPC ..... B65H 1/00; B65H 1/04; B65H 3/44; B65H 7/00; B65H 2405/00; B65H 2405/10; B65H 2551/00; B65H 2551/10; B65H 2551/20; B65H 2301/1422; B65H 2701/1916; G03G 15/6508; G03G 15/6514
See application file for complete search history.

(56) References Cited

U.S. PATENT DOCUMENTS 3,951,264 A 4/1976 Heidecker et al.
5,003,493 A * 3/1991 Okada et al. ..... 399/388
(Continued)

FOREIGN PATENT DOCUMENTS

CN 1206680 A 2/1999
CN 1453652 A 11/2003
(Continued)

OTHER PUBLICATIONS

Chinese Office Action dated Aug. 19, 2014 issued in corresponding Chinese Patent Application No. 201210509501.3.
(Continued)

*Primary Examiner* — Prasad Gokhale
(74) *Attorney, Agent, or Firm* — Fitzpatrick, Cella, Harper & Scinto

(57) ABSTRACT

This invention relates to a printing apparatus and control method thereof. The standard size of an envelope to be stored in each of a plurality of paper storage units configured to store an envelope to be used in printing is set. An offset amount to be used to print an image on an envelope of the set standard size is set. A paper storage unit which stores an envelope to be used in printing is selected from the plurality of paper storage units based on a standard size of an envelope that is designated by a user. The position of an image is shifted in accordance with the set offset amount, and the image is printed on an envelope fed from the selected paper storage unit.

3 Claims, 20 Drawing Sheets

(51) Int. Cl.
*B41J 11/00* (2006.01)
*B41J 13/12* (2006.01)

(56) References Cited

U.S. PATENT DOCUMENTS

| | | | | |
|---|---|---|---|---|
| 5,154,405 | A | 10/1992 | Graveson et al. | |
| 5,999,765 | A | 12/1999 | Tomita | |
| 6,179,288 | B1 | 1/2001 | Bezelga et al. | |
| 6,234,468 | B1 | 5/2001 | Janatka et al. | |
| 6,356,719 | B1 | 3/2002 | Yoshiura | |
| 6,688,593 | B1 | 2/2004 | Auerbach | |
| 6,895,195 | B2 | 5/2005 | Katamoto | |
| 7,017,819 | B2 | 3/2006 | Beskitt et al. | |
| 7,079,781 | B2 | 7/2006 | Suzuki et al. | |
| 7,284,753 | B2 | 10/2007 | Kotani | |
| 7,347,420 | B2 | 3/2008 | Kobayashi et al. | |
| 7,510,182 | B2 | 3/2009 | Bobrow | |
| 7,841,594 | B2 | 11/2010 | Janatka et al. | |
| 8,305,608 | B2 | 11/2012 | Saito | |
| 8,330,783 | B2 | 12/2012 | Salvestro | |
| 8,523,165 | B2 | 9/2013 | Kunieda et al. | |
| 8,988,724 | B2 * | 3/2015 | Inui | 358/1.16 |
| 2007/0165101 | A1 | 7/2007 | Makino | |
| 2008/0084020 | A1 * | 4/2008 | Nakamura | 270/1.01 |
| 2008/0260406 | A1 | 10/2008 | Sone et al. | |
| 2009/0166949 | A1 * | 7/2009 | Unno | 271/9.03 |
| 2010/0067050 | A1 | 3/2010 | Matsuura et al. | |
| 2010/0295235 | A1 | 11/2010 | Kanamoto | |
| 2011/0184889 | A1 * | 7/2011 | Tokita et al. | 705/414 |
| 2013/0140767 | A1 * | 6/2013 | Inui | 271/264 |
| 2013/0168915 | A1 | 7/2013 | Saito | |
| 2013/0214481 | A1 * | 8/2013 | Yamada | 271/227 |
| 2013/0321863 | A1 * | 12/2013 | Fukuda | 358/1.15 |
| 2013/0329241 | A1 * | 12/2013 | Hirao | 358/1.12 |

FOREIGN PATENT DOCUMENTS

| | | | |
|---|---|---|---|
| CN | 1542559 | A | 11/2004 |
| CN | 1759423 | A | 4/2006 |
| CN | 201151240 | Y | 11/2008 |
| CN | 101970240 | A | 2/2011 |
| CN | 103129182 | A | 6/2013 |
| JP | 9-109492 | A | 4/1997 |
| JP | 9-281853 | A | 10/1997 |
| JP | 11-275304 | A | 10/1999 |
| JP | 2001-228778 | A | 8/2001 |
| JP | 2007-69390 | A | 3/2007 |
| JP | 2007-172343 | A | 7/2007 |
| JP | 2010-74251 | A | 4/2010 |
| JP | 2010-74311 | A | 4/2010 |
| JP | 2011-101973 | A | 5/2011 |

OTHER PUBLICATIONS

Chinese Office Action dated Sep. 23, 2014 issued in corresponding Chinese Patent Application No. 20120587552.8.

Chinese Office Action dated Oct. 10, 2014 issued in corresponding Chinese Patent Application No. 201210511123.2.

Japanese Office Action dated Oct. 30, 2015 issued in corresponding Japanese Patent Application No. 2011-264120.

* cited by examiner

FIG. 13

| 1201 ATTRIBUTE ID | 1202 TYPE ID | 1203 VALUE | 1204 MEANING |
|---|---|---|---|
| 10 | 1 | ARBITRARY CHARACTER STRING | JOB NAME |
| 11 | 1 | ARBITRARY CHARACTER STRING | APPLICATION NAME |
| 100 | 2 | 1, 2, 3, 4, 5 or AUTO | PAPER SOURCE |
| 101 | 2 | 1, 2, 3, 4 | DISCHARGE TRAY |
| 104 | 2 | 3 | COPY COUNT |
| ⋮ | ⋮ | ⋮ | ⋮ |
| 401 | 11 | 0~7015, 0~9920 | IMAGE SIZE |
| 402 | 11 | 0~7015, 0~9920 | MOVING AMOUNT |
| 403 | 2 | A4, A3, B5, B4, POSTCARD, END-OPENING ENVELOPE(LONG FORMAT) 3 | PAPER SIZE |
| 404 | 2 | PLAIN PAPER, THICK PAPER, COATED PAPER, ENVELOPE | PAPER TYPE |
| 405 | 2 | 1, 2, 3 | DOUBLE-SIDED |
| 406 | 2 | 1, 2, 3, 4 | BINDING POSITION |

PRINTING APPARATUS, CONTROL METHOD THEREOF AND STORAGE MEDIUM STORING PROGRAM

This application is a continuation of U.S. application Ser. No. 13/674,868, filed Nov. 12, 2012 (pending), the contents of which are incorporated herein by reference.

BACKGROUND OF THE INVENTION

1. Field of the Invention

The present invention relates to a printing apparatus capable of printing an image on an envelope, a control method thereof, and a storage medium storing a program.

2. Description of the Related Art

A printing apparatus generally includes one or more paper storage units. The printing apparatus feeds sheets stored in the paper storage unit one by one, and forms an image on it. The size of paper stored in each paper storage unit can be set. For example, standard sizes such as A4 and B4, and an arbitrary size such as 210 mm×290 mm can be set. As a special standard size, an envelope size can also be set. Paper with a projection such as the margin (to be referred to as a flap hereinafter) of an envelope or the index portion of index paper is set so that the projection serves as the trailing end in the sub-scanning direction. With this setting, a paper area up to the projection (paper area excluding the projection) is handled as a standard size and printed. Also, there is known a technique of setting an envelope so that its flap serves as the leading end in the conveyance direction, recognizing a flap position by a sensor when the envelope is conveyed, and suppressing image misregistration (see Japanese Patent Laid-Open No. 9-109492).

In general, an envelope is longer in the sub-scanning direction than in the main scanning direction. The printing time becomes long in a conventional method of setting the sub-scanning direction (long edge) of an envelope parallel to the conveyance direction, and conveying the envelope (this will be called short-edge feed).

The time taken to print can be shortened by setting an envelope so that its flap comes to the main scanning side, and conveying the envelope (this will be called long-edge feed). However, the width of the flap differs between envelope manufacturers. For this reason, the user needs to measure lengths of an envelope in the main scanning direction and sub-scanning direction, input the measured lengths, and register the envelope as paper of a user-defined size. When the envelope is registered as paper of a user-defined size, the user cannot use an auto paper selection function of automatically selecting paper for use based on the size of an original image, and printing.

SUMMARY OF THE INVENTION

An aspect of the present invention is to eliminate the above-mentioned problems with the conventional technology.

The present invention provides a mechanism of enabling automatically selecting an envelope and printing by the auto paper selection function, and printing an image at a correct position on a selected envelope based on the offset amount of the envelope.

The present invention in its first aspect provides a printing apparatus comprising: a plurality of paper storage units configured to store an envelope to be used in printing; a size setting unit configured to set a standard size of an envelope to be stored in each of the plurality of paper storage units; an offset setting unit configured to set an offset amount to be used to print an image on an envelope of the standard size set by the size setting unit; a selection unit configured to select a paper storage unit which stores an envelope to be used in printing, from the plurality of paper storage units based on a standard size of an envelope that is designated by a user; and a printing control unit configured to shift a position of an image in accordance with the offset amount set by the offset setting unit and print the image on an envelope fed from the paper storage unit selected by the selection unit.

The present invention in its second aspect provides a method of controlling a printing apparatus which includes a plurality of paper storage units configured to store an envelope to be used in printing and can print an image on an envelope fed from a paper storage unit, comprising: a size setting step of setting a standard size of an envelope to be stored in each of the plurality of paper storage units; an offset setting step of setting an offset amount to be used to print an image on an envelope of the standard size set in the size setting step; a selection step of selecting a paper storage unit which stores an envelope to be used in printing, from the plurality of paper storage units based on a standard size of an envelope that is designated by a user; and a printing control step of shifting a position of an image in accordance with the offset amount set in the offset setting step and printing the image on an envelope fed from the paper storage unit selected in the selection step.

The present invention in its third aspect provides a computer-readable storage medium storing a program for causing a computer to execute a size setting step of setting a standard size of an envelope to be stored in each of a plurality of paper storage units, an offset setting step of setting an offset amount to be used to print an image on an envelope of the standard size set in the size setting step, a selection step of selecting a paper storage unit which stores an envelope to be used in printing, from the plurality of paper storage units based on a standard size of an envelope that is designated by a user, and a printing control step of shifting a position of an image in accordance with the offset amount set in the offset setting step and printing the image on an envelope fed from the paper storage unit selected in the selection step.

According to the present invention, an envelope can be automatically selected to print by the auto paper selection function, and an image can be printed at a correct position on a selected envelope based on the offset amount of the envelope.

Further features of the present invention will become apparent from the following description of exemplary embodiments with reference to the attached drawings.

BRIEF DESCRIPTION OF THE DRAWINGS

FIG. 13 is a table exemplifying the data attribute of a job according to the embodiment;

DESCRIPTION OF THE EMBODIMENTS

Preferred embodiments of the present invention will now be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
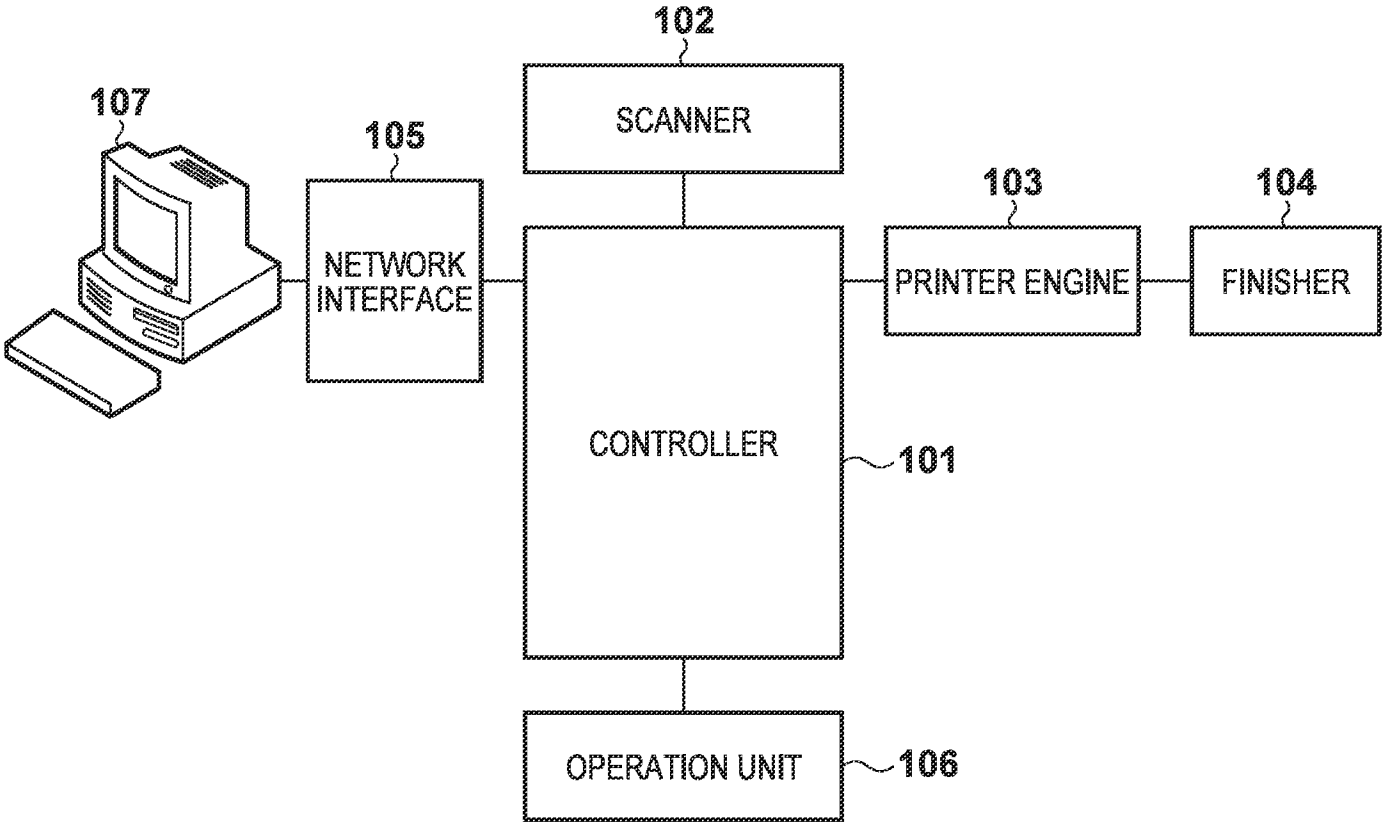
FIG. 1 is a view showing the arrangement of a multi-function peripheral serving as an example of an image forming apparatus according to an embodiment.

FIG. 1 is a view showing the arrangement of a multi-function peripheral (MFP) serving as an example of a printing apparatus according to an embodiment of the present invention. Although the embodiment will be explained using the MFP having a plurality of functions as an example of the printing apparatus, the printing apparatus may be a single-function peripheral (SFP) having a single function.

Figure 2:
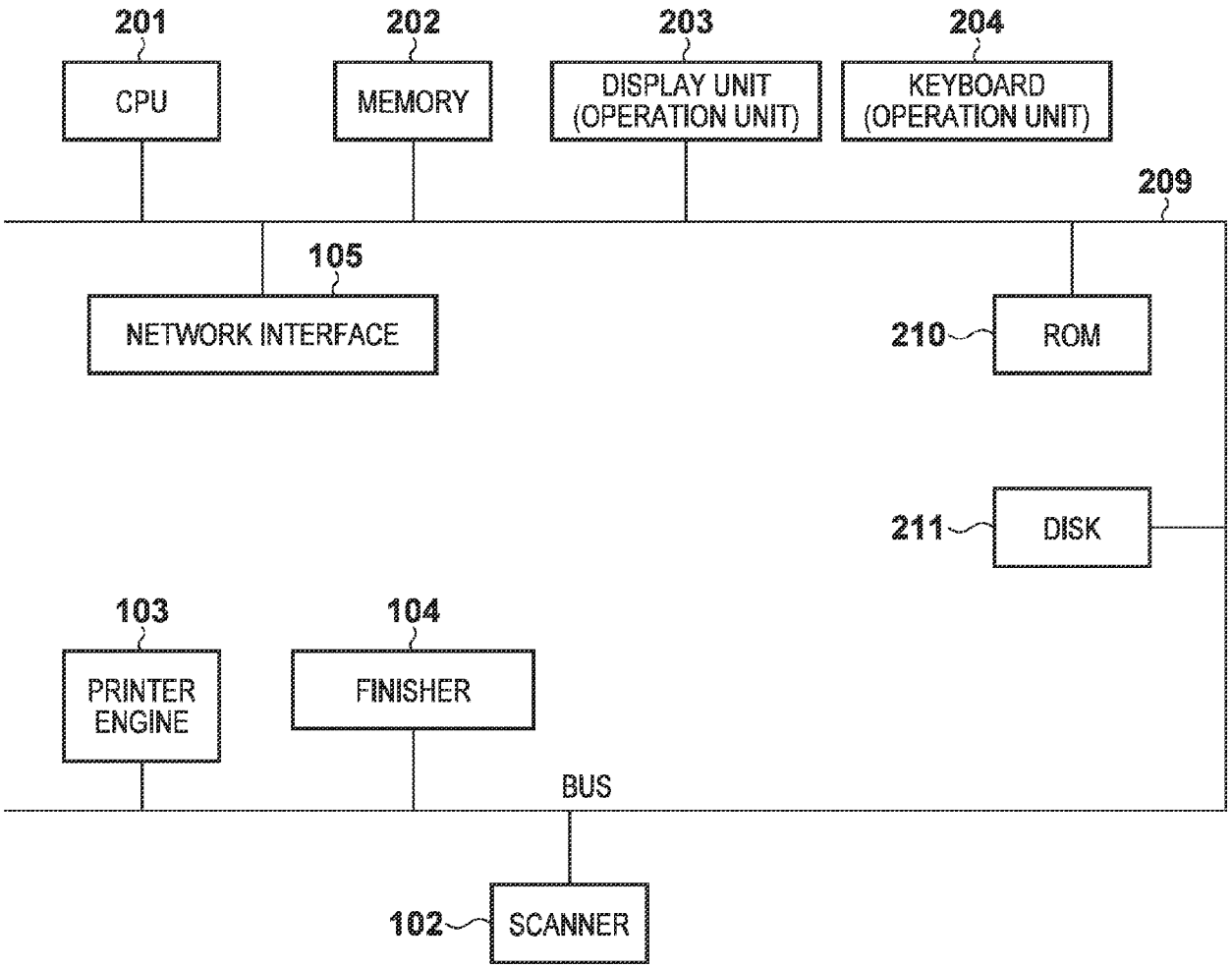
FIG. 2 is a block diagram showing the hardware arrangement of a controller according to the embodiment.

Referring to FIG. 1, a controller 101 controls the MFP, and has a hardware arrangement shown in FIG. 2. A scanner 102 is controlled by the controller 101, and scans an original to create image data of the original image. A printer engine 103 is a printer engine complying with the electrophotographic method in the embodiment. The printer engine 103 prints an image on a printing medium (sheet such as paper or envelope) under the control of the controller 101. A finisher 104 is connected to the printer engine 103, and can perform, for example, staple processing collectively for a plurality of printing media (for example, sheets) output from the printer engine 103. The controller 101 also controls the finisher 104. A network (Ethernet) interface 105 provides two-way communication via it to the controller 101, and can connect the MFP to a PC 107 via a network. An operation unit 106 provides a user interface, includes a display and keyboard, displays information from the controller 101, and notifies the controller 101 of an instruction from the user.

FIG. 2 is a block diagram showing the hardware arrangement of the controller 101 according to the embodiment.

In the controller 101, a CPU 201 is connected to a memory 202, a display unit 203 and keyboard 204 of the operation unit 106, a ROM 210, and a DISK 211 via a bus 209. Various programs and data are stored in the DISK 211 (storage medium) such as a hard disk or Floppy® disk, and if necessary, sequentially read out to the memory 202 and executed by the CPU 201. The DISK 211 may be one detachable from the MFP or one incorporated in the MFP. Further, programs may be downloaded from another PC, MFP, or the like via the network and stored in the DISK 211.

The memory 202 may have both the functions of volatile and nonvolatile memories. Alternatively, the memory 202 may have the function of a volatile memory, and the DISK 211 may have the function of a nonvolatile memory. The memory 202 may be a removable memory medium.

The CPU 201 writes display data in a display memory (not shown) to present a display on the display unit 203. The CPU 201 receives data from the keyboard 204 or the display unit 203 serving as a touch panel, thereby receiving an instruction from the user. The input information is transferred to one of the memory 202, DISK 211, and CPU 201, accumulated, and used for various processes. The network interface 105 is connected to the bus 209, and the CPU 201 performs communication via the interface by loading or writing data via the network interface 105.

Further, the printer engine 103, finisher 104, and scanner 102 are connected to the bus 209. The CPU 201 reads and writes data from and in the printer engine 103, finisher 104, and scanner 102 to perform operations such as printing and scanning, and acquire various statuses. Image data can be saved in the DISK 211 or memory 202 of the controller 101 from the scanner 102 or network interface 105. Also, image data can be accumulated in advance in a removable memory and loaded by attaching the memory to the controller 101. Image data accumulated in the DISK 211 can be moved or copied to the memory 202. Various additional images (for example, a page number) can be composited to image data in the memory 202 in accordance with contents designated from the operation unit 106. Note that the printer engine 103, finisher 104, and scanner 102 may exist not in the MFP but as single peripheral devices on the network, and may be controlled by the controller 101 of the MFP.

Figure 3:
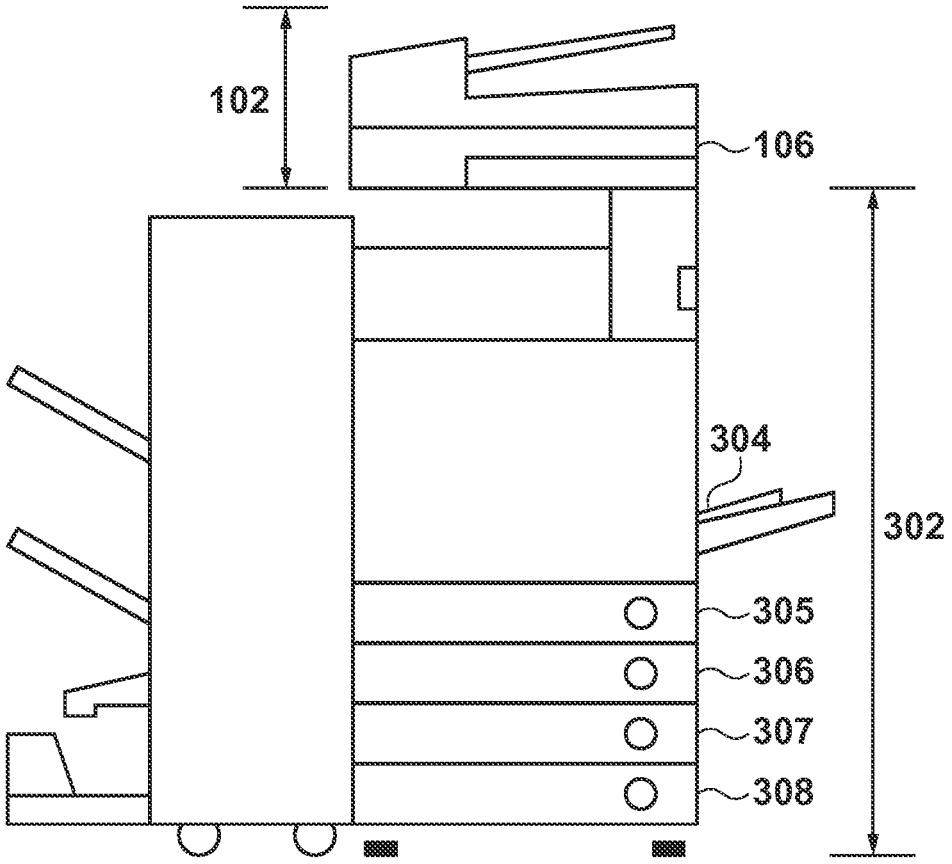
FIG. 3 is a schematic view showing the MFP according to the embodiment.

FIG. 3 is a schematic view showing the MFP according to the embodiment.

The scanner 102 serving as an image input device illuminates an image on a sheet serving as an original, and scans a CCD line sensor to convert the original image into electrical image data. The color and size of the original are determined from the electrically converted image data. A printer unit 302 serving as an image output device is a unit which converts image data into an image on a sheet. After printing on sheets, the printer unit 302 performs processes such as stapling and bookbinding, and outputs the sheets. The print operation starts and stops in accordance with instructions from the CPU 201 of the controller 101. Reference numerals 304 to 308 denote paper sources. The paper source 304 is a manual feed tray, and the paper sources 305 to 308 are paper cassettes (paper storage units), in each of which a plurality of sheets can be set. Note that the MFP can print an image on an envelope stored in the paper cassette based on print data.

Figure 4:
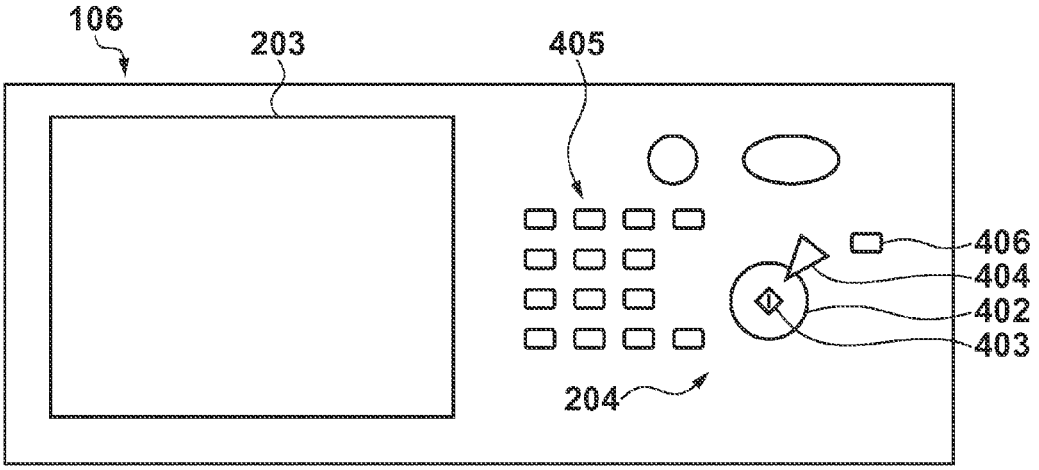
FIG. 4 is a plan view showing the operation unit of the MFP according to the embodiment.

FIG. 4 is a plan view showing the operation unit 106 of the MFP according to the embodiment.

The display unit 203 is formed from a touch panel sheet adhering to a liquid crystal display, and displays an operation screen and soft keys. When the user presses a displayed key, the display unit 203 notifies the CPU 201 of the position information.

Next, the keyboard 204 will be explained. A start key 402 is used to designate the start of an original image reading operation. An LED 403 in two, green and red colors is arranged at the center of the start key 402, and the color represents whether the start key 402 is available. A stop key 404 is used to stop an operation in progress. A ten-key pad 405 is formed from numeric and character buttons, and used to set a copy count and designate screen switching of the display unit 203 and the like. A user mode key 406 is pressed to make settings of the MFP.

Figure 5A:
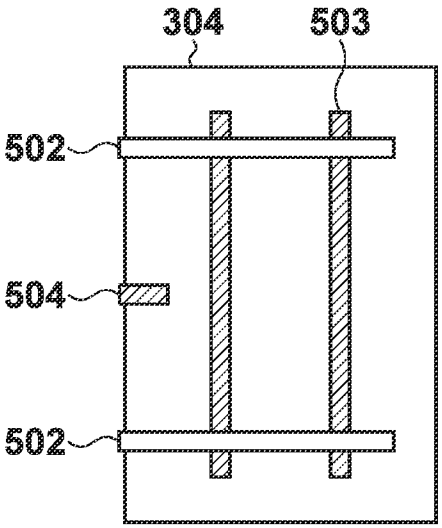
FIGS. 5A to 5C are views showing a manual feed tray when viewed from above.
Figure 5B:
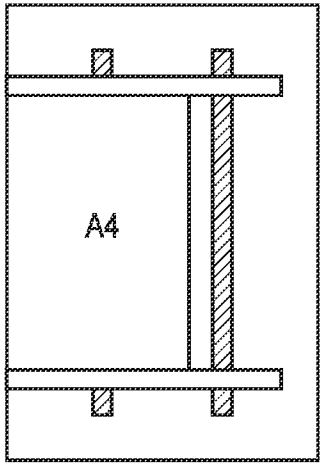
Figure 5C:
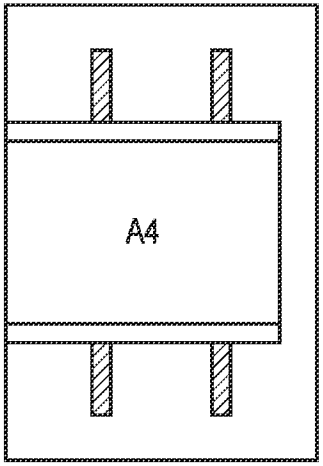

FIGS. 5A to 5C are views showing the manual feed tray 304 when viewed from above.

In FIG. 5A, the manual feed tray 304 includes guides 502 which are freely movable on rails 503. The positions of the guides 502 can be adjusted in accordance with the size of paper to be set. FIG. 5B shows guide positions when A4-size paper is set in the portrait direction. This represents a conveyance direction in long-edge feed described above. FIG. 5C shows guide positions when A4-size paper is set in the landscape direction. This represents a conveyance direction in short-edge feed described above. A sensor 504 detects that paper is placed on the manual feed tray 304. When paper is placed on the sensor 504, the controller 101 can detect that paper is set on the manual feed tray 304.

FIGS. 6A, 6B, 7A, 7B, 8A, and 8B are views each exemplifying a UI screen displayed on the display unit 203 of the operation unit 106 of the MFP according to the embodiment. A method of setting a size for a paper cassette and setting a paper type from a user mode screen in FIG. 6A will be explained with reference to FIGS. 6A, 6B, 7A, 7B, 8A, and 8B.

Figure 6A:
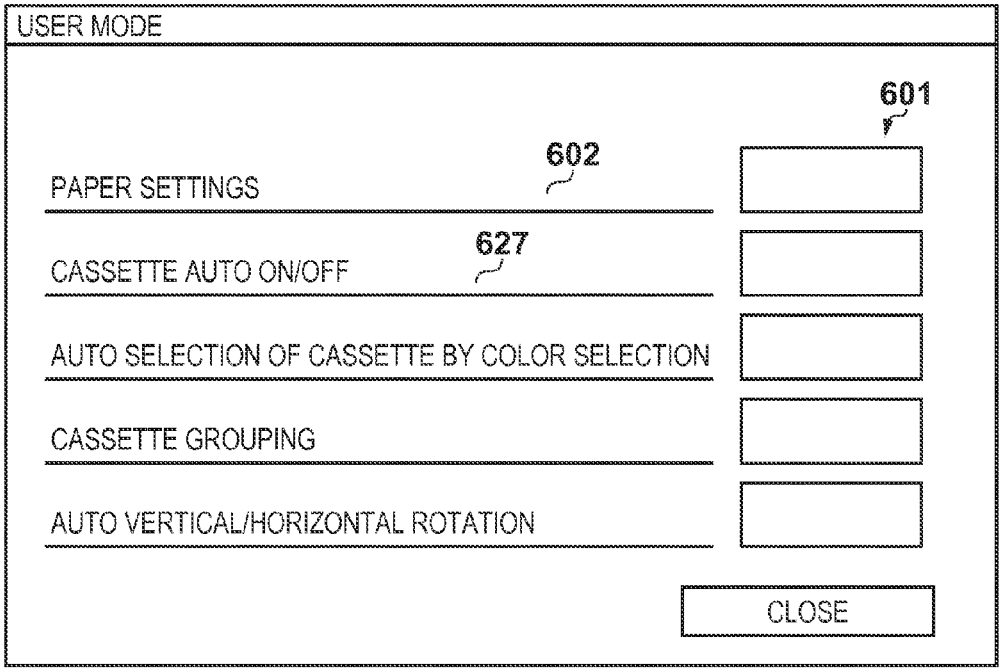
FIGS. 6A and 6B are views each exemplifying a UI screen displayed on the display unit of the operation unit of the MFP according to the embodiment.

When the user presses the user mode key 406 of the operation unit 106, a user mode screen in FIG. 6A appears. The user can set a paper size from this screen. When the user presses a button 602 corresponding to paper settings in a button group 601, a screen shown in FIG. 6B for setting the size and type of paper to be set in the paper cassette appears.

Figure 6B:
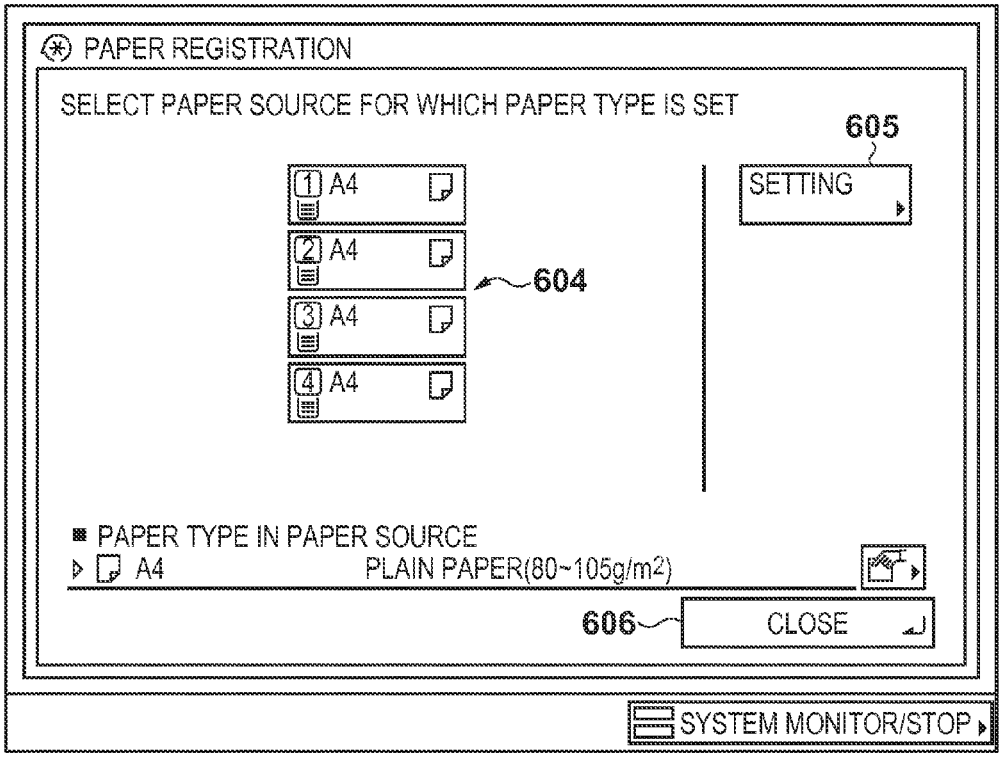

The screen in FIG. 6B provides a cassette selection button group 604. By pressing a button in the cassette selection button group 604, the user can select an arbitrary paper cassette. When the user selects a paper cassette from the button group 604 and presses a set button 605, a screen shown in FIG. 7A appears.

Figure 7A:
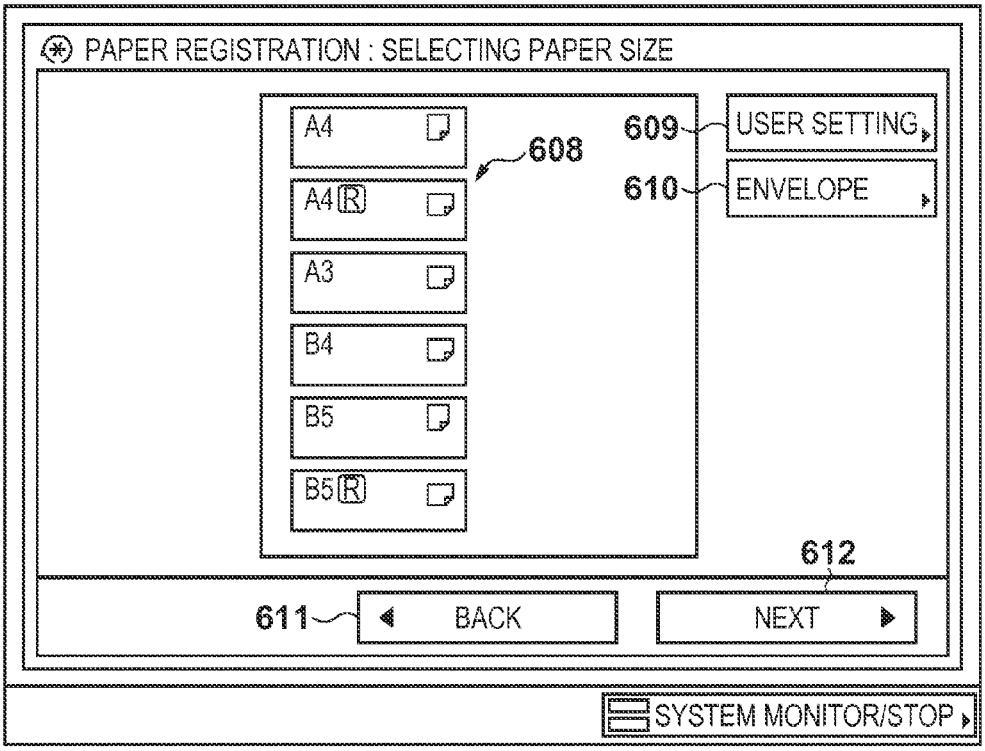
FIGS. 7A and 7B are views each exemplifying a UI screen displayed on the display unit of the operation unit of the MFP according to the embodiment.

The screen in FIG. 7A provides a standard size setting button group 608. By pressing a button in the button group 608, the user can set an arbitrary standard size for the paper cassette selected in FIG. 6B. The user presses a user setting button 609 to set paper of an arbitrary size. When the user presses the user setting button 609, a screen shown in FIG. 7B appears.

Figure 7B:
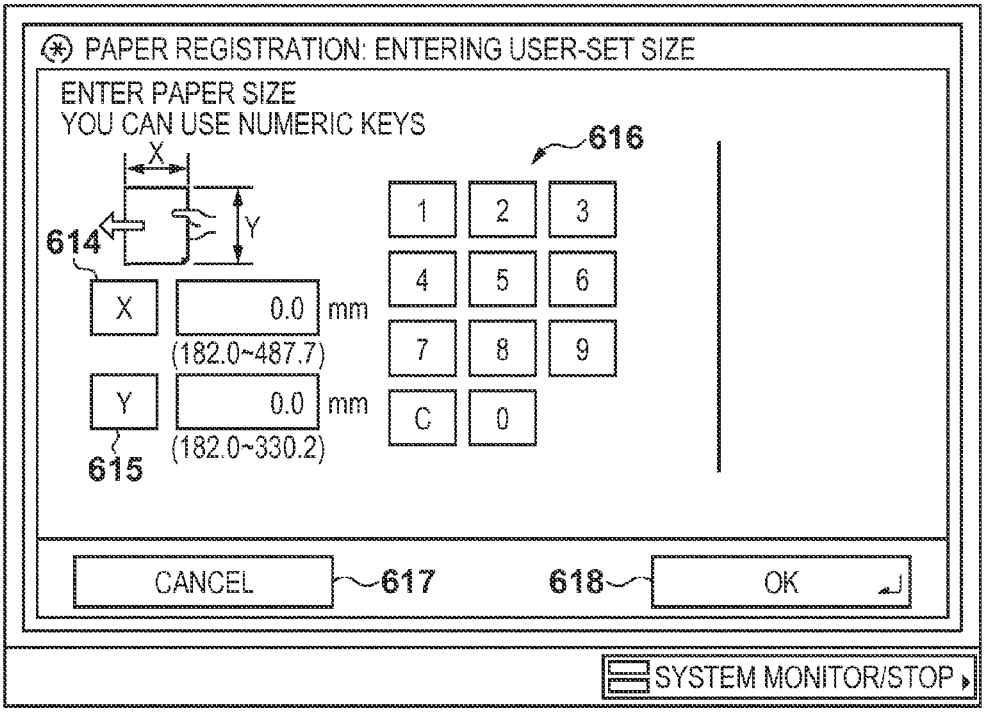

The user presses an X button 614 in FIG. 7B to set a length in the lateral direction. With a numeric button group 616, the user sets the length. The user presses a Y button 615 to set a length in the longitudinal direction. With a numeric button group 616, the user sets the length. The user presses a cancel button 617 to cancel settings on the screen. When the user presses the cancel button 617, the screen in FIG. 7B returns to one in FIG. 7A without any setting. The user presses an OK button 618 to end input of lengths in the longitudinal and lateral directions, and set these values. When the user presses the OK button 618, the screen in FIG. 7B returns to one in FIG. 7A.

Figure 8A:
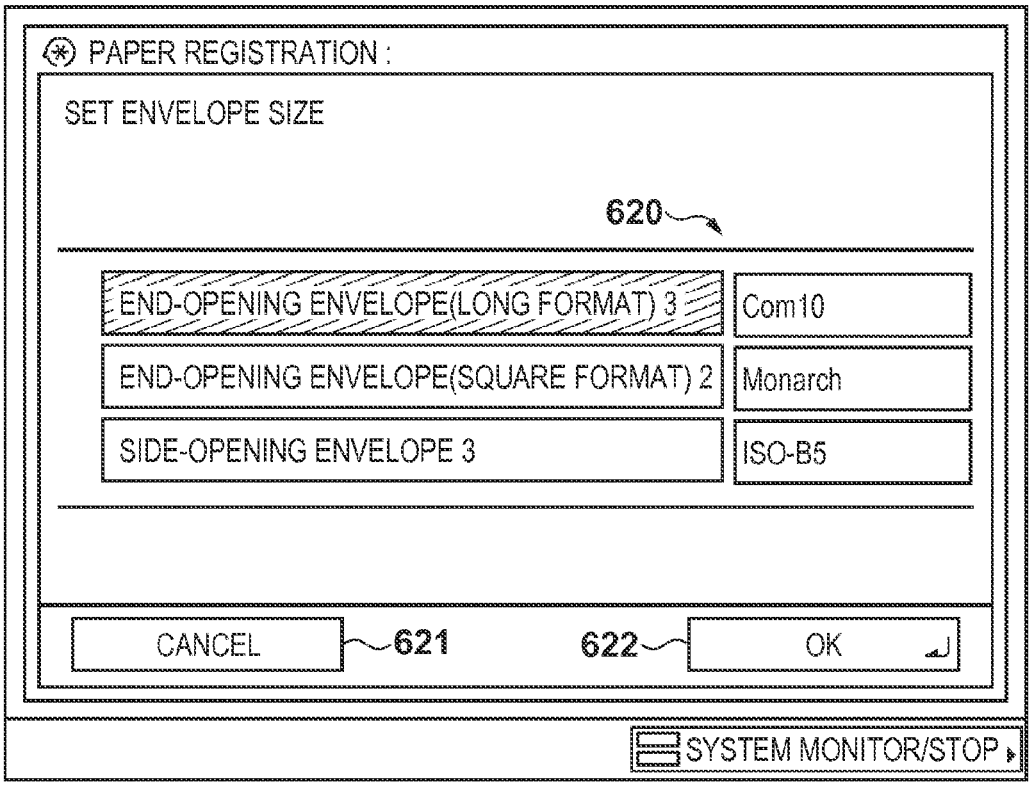
FIGS. 8A and 8B are views each exemplifying a UI screen displayed on the display unit of the operation unit of the MFP according to the embodiment.

The user presses an envelope button 610 in FIG. 7A to set an envelope size. When the user presses the envelope button 610, a screen in FIG. 8A appears. The screen in FIG. 8A provides an envelope size setting button group 620. By pressing a button in the button group 620, the user can set the standard size of an envelope. The standard size of an envelope means a frequently used envelope size among various types of envelopes. The standard sizes of envelopes include, for example, "End-opening envelope (long format) 3", "End-opening envelope (square format) 2", "Side-opening envelope 3", "Com10", "Monarch", and "ISO-B5" exemplified in FIG. 8A. In the button group 620, "End-opening envelope (long format) 3" is selected as a default. The default changes depending on the destination (destination is information indicating a country or region where a device is installed, and is saved in either the memory 202 or DISK 211 of the controller 101). The default is "End-opening envelope (long format) 3" for Japan and "Com10" for overseas. The user presses a cancel button 621 to cancel settings on the screen. When the user presses the cancel button 621, the screen in FIG. 8A returns to one in FIG. 7A without any setting. The user presses an OK button 622 to decide an envelope size. When the user presses the OK button 622, an envelope size is set, and the screen in FIG. 8A returns to one in FIG. 7A.

Figure 8B:
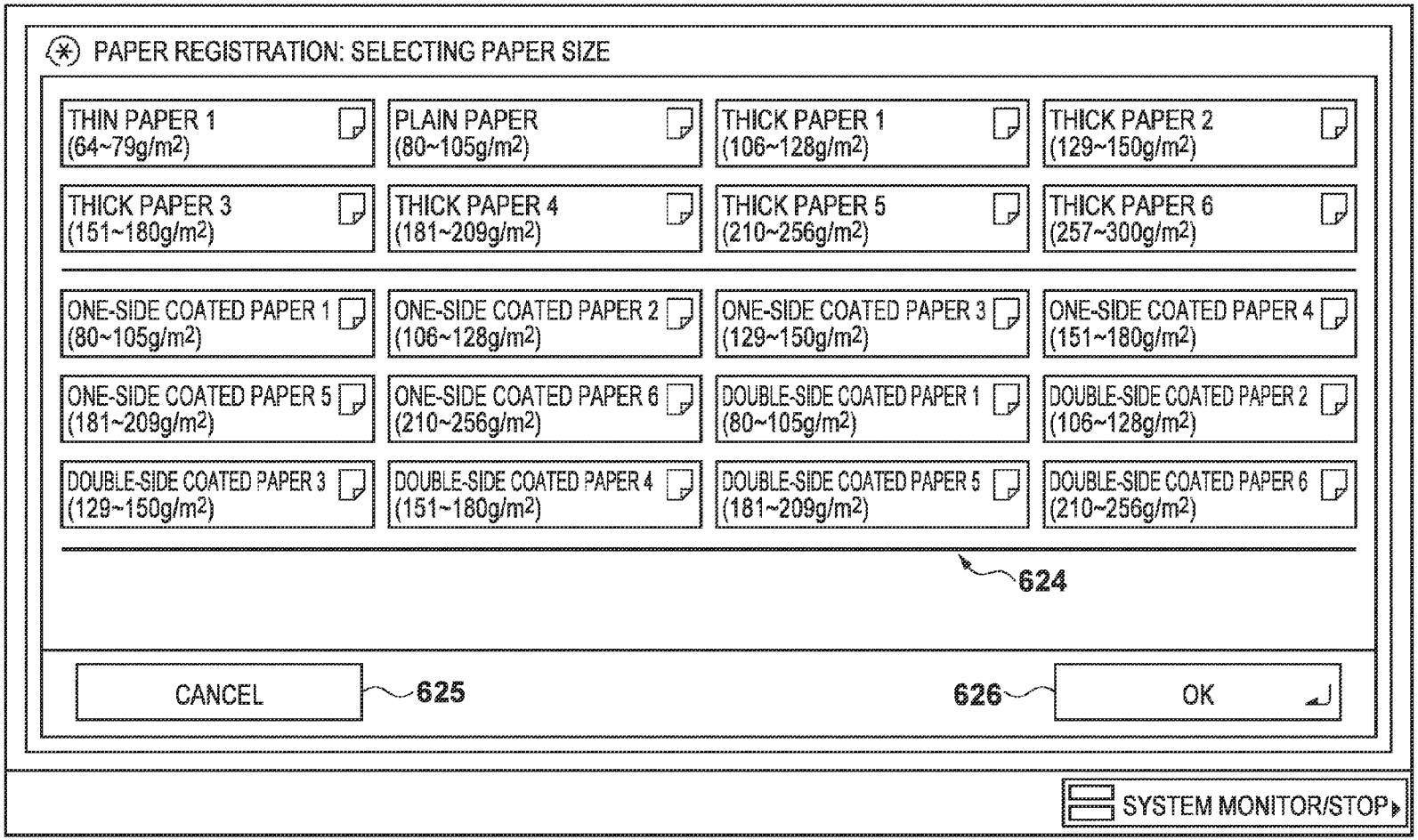

When the user sets a standard size or user-set size as the envelope size and then presses a Next button 612 in FIG. 7A, a screen in FIG. 8B appears. This screen provides a paper type setting button group 624. By pressing a button in the button group 624, the user can set a paper type. The user presses a cancel button 625 to cancel settings on the screen. When the user presses the cancel button 625, the screen in FIG. 8B returns to one in FIG. 7A without any setting. The user presses an OK button 626 to decide a paper type. When the user presses the OK button 626, a paper type is set, and the screen in FIG. 8B returns to one in FIG. 6A. Further, when the user wants to set another paper source, he selects a paper cassette again from the cassette selection button group 604, and repeats setting processing. If no more setting is made, the user presses a close button 606, and then the screen returns to one in FIG. 6A.

Table 1 below exemplifies information set for each paper cassette according to the embodiment. After the end of paper setting processing, data for one of cassette 1 to cassette 4 in Table 1 is updated. The data can be saved in either the memory 202 or DISK 211 of the controller 101.

TABLE 1

| Cassette Source | Paper Size | X Size | Y Size | Paper Type | Feed |
|---|---|---|---|---|---|
| Cassette 1 | A4 | — | — | Plain paper | Longitudinal |
| Cassette 2 | End-opening envelope (long format) 3 | — | — | Thick paper | Lateral |
| Cassette 3 | User setting | 200 mm | 297 mm | Plain paper | Lateral |
| Cassette 4 | B4 | — | — | Plain paper | Longitudinal |
| Manual Feed | Unset | — | — | Unset | — |

Next, a method of setting the size and type of paper when paper is set on the manual feed tray 304 will be explained. When the user sets paper on the manual feed tray 304 and sets a state as shown in FIG. 5B or 5C, the sensor 504 reacts and the printer engine 103 notifies the controller 101 that paper has been set. Upon receiving this notification, the controller 101 displays the screen shown in FIG. 7A on the display unit 203 of the operation unit 106. In this case, a Back button 611 is hidden. As described above, when the user sets a standard size or user-set size as the envelope size on this screen and then presses the Next button 612, the screen in FIG. 8B appears. As described above, this screen provides the paper type setting button group 624. The user can set a paper type by pressing a button in the paper type setting button group 624, or returns the screen in FIG. 8B to one in FIG. 7A with the cancel button 625. When the user presses the OK button 626 after the end of setting, the paper registration screen disappears, and the size and paper type in "Manual Feed" of Table 1 are updated from "unset" to an actually set size and type. When no paper remains on the manual feed tray 304, the sensor 504 reacts and the printer engine 103 notifies the controller 101 that no paper remains. Upon receiving this notification, the controller 101 updates each item in "Manual Feed" of Table 1 to "unset".

Figure 9:
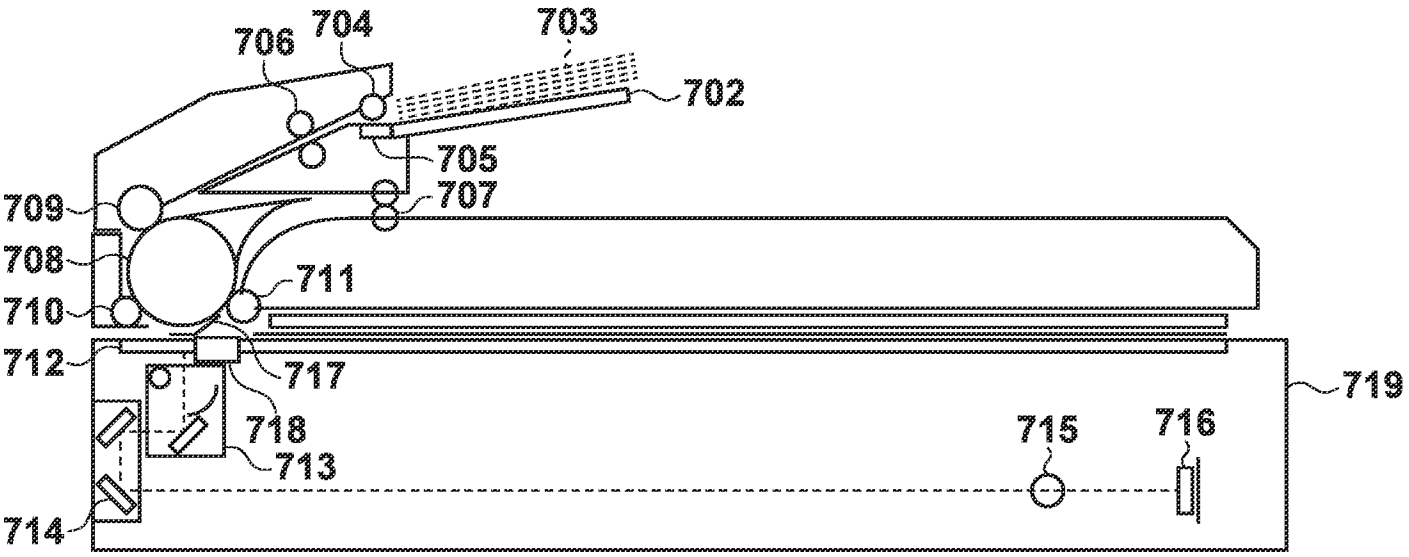
FIG. 9 is a view for explaining the structure of a scanner according to the embodiment.

FIG. 9 is a view for explaining the structure of the scanner 102.

Information on an original 703 is read while the original 703 is moved relatively to an exposure unit 713 of an original reading device 719. The original 703 is set on an original tray 702. An original feed roller 704 is paired with a separation pad 705, and conveys the originals 703 one by one. The conveyed original 703 is sent into the scanner by intermediate rollers 706, conveyed by a large roller 708 and first driven roller 709, and further conveyed by the large roller 708 and a second driven roller 710. The original 703 conveyed by the large roller 708 and second driven roller 710 passes between a sheet-fed original glass 712 and an original guide plate 717, and conveyed by the large roller 708 and a third driven roller 711 via a jump table 718. The original 703 conveyed by the large roller 708 and third driven roller 711 is discharged by a pair of original discharge rollers 707. Note that the original 703 is conveyed between the sheet-fed original glass 712 and the original guide plate 717 to contact the sheet-fed original glass 712 by the original guide plate 717.

When the original 703 passes on the sheet-fed original glass 712, the exposure unit 713 exposes a surface of the original 703 that contacts the sheet-fed original glass 712. Resultant light reflected by the original 703 travels to a mirror unit 714. The traveling reflected light is condensed through a lens 715, and converted into an electrical signal by a CCD sensor 716. The electrical signal is transferred to the controller 101.

Figure 10:
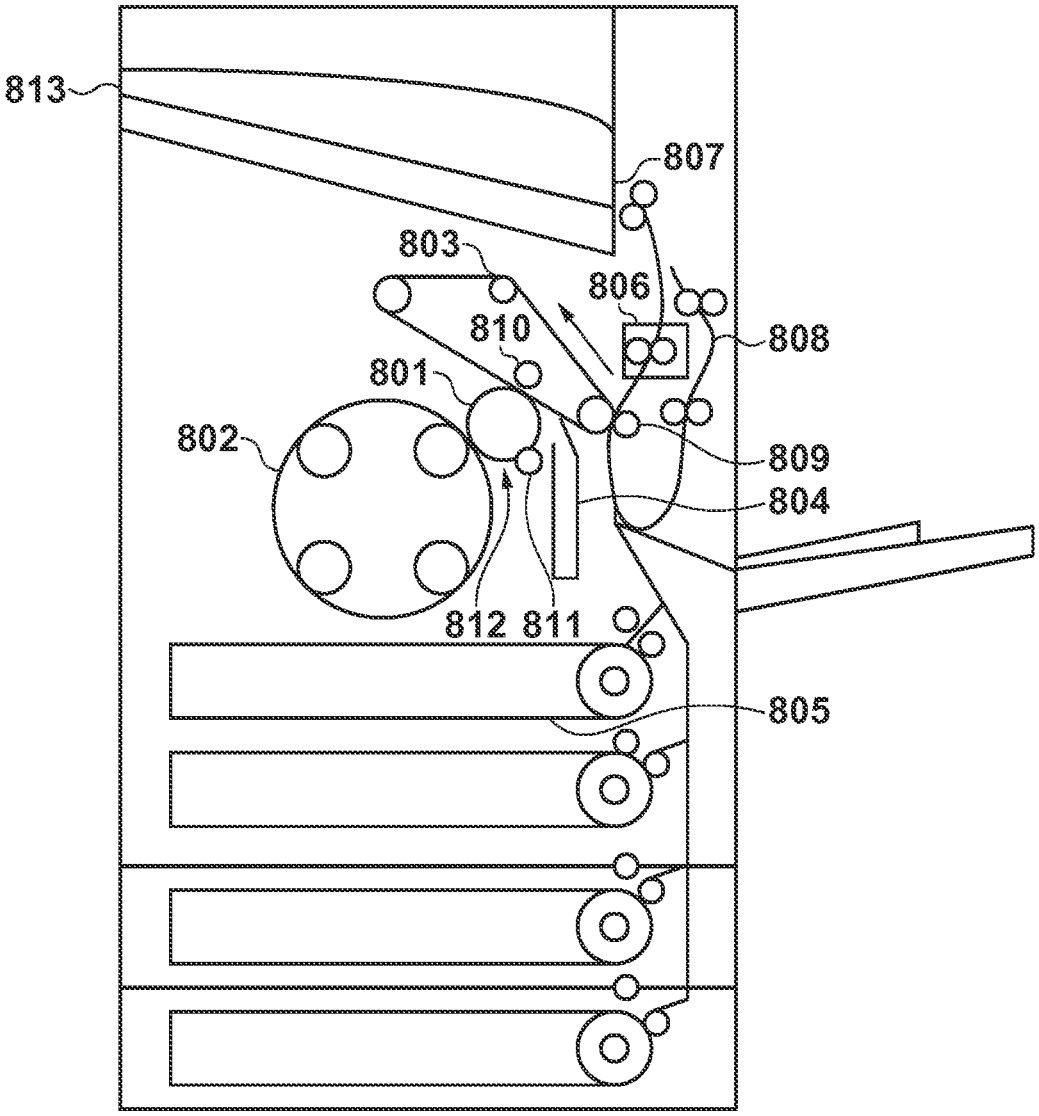
FIG. 10 is a view for explaining the arrangement of a printer unit according to the embodiment.

FIG. 10 is a view for explaining the arrangement of the printer unit 302.

FIG. 10 exemplifies a full-color printing apparatus. A primary charger 811 charges a photosensitive drum 801 to a potential of a specific polarity, and an exposure means (not shown) exposes a position indicated by an arrow 812 in accordance with an instruction from the controller 101. As a result, an electrostatic latent image corresponding to the first color component is formed. After that, the electrostatic latent image is developed using one of four developing units of a developing device 802. An intermediate transfer belt 803 is driven in a direction indicated by an arrow. When the image of the first color component formed on the photosensitive drum 801 passes through a contact portion between the photosensitive drum 801 and the intermediate transfer belt 803, it is transferred onto the intermediate transfer belt 803 by an electric field formed by a primary transfer roller 810. A cleaning device 804 cleans the surface of the photosensitive drum 801 after the transfer onto the intermediate transfer belt 803. This processing is sequentially repeated, forming a color image by superposing images of four colors onto the intermediate transfer belt 803. When an image of a single color is formed, transfer processing is performed only once. The image transferred onto the intermediate transfer belt 803 is printed onto paper fed from a paper cassette 805 by a secondary transfer roller 809. A fixing unit 806 heats and fixes the paper on which the image is printed. After the fixing, the paper passes through a portion 807, is conveyed to a discharge port 813, and discharged from the printer unit 302. When double-sided printing is performed, paper bearing an image printed on one surface is circulated through a reverse path 808, and an image is printed on its reverse surface.

Figure 11:
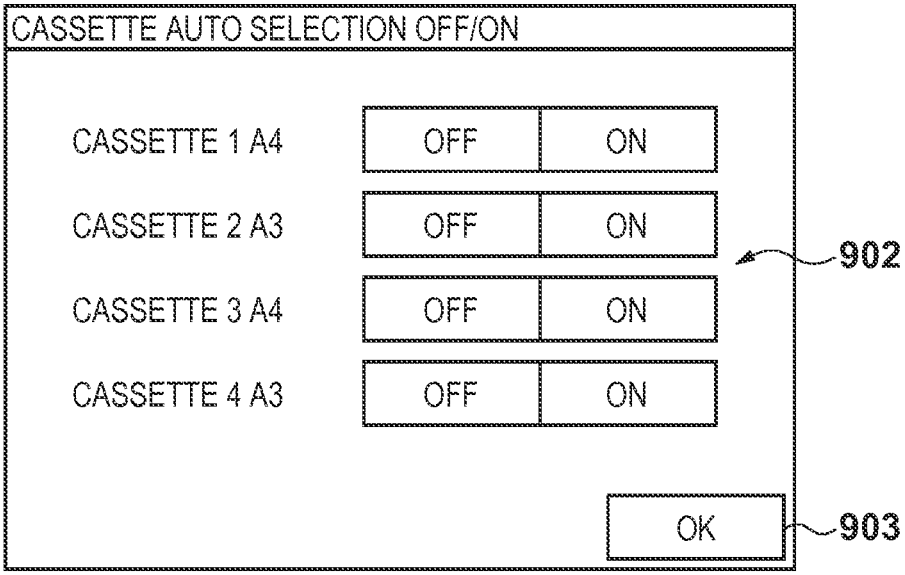
FIG. 11 is a view exemplifying a UI screen for selecting a paper cassette subjected to auto paper selection.

FIG. 11 is a view exemplifying a UI screen for selecting a paper cassette subjected to auto paper selection. Auto paper selection is processing of automatically selecting a paper source serving as the source of paper to be used in printing from a plurality of paper sources by the CPU 201 in accordance with the original size and user settings.

When the user presses the user mode key 406 of the operation unit 106, the user mode screen in FIG. 6A appears. When the user presses a button corresponding to a cassette auto ON/OFF setting 627 in the button group 601, the screen shown in FIG. 11 appears. This screen displays equipped paper cassettes and the size of paper set in each paper cassette. With a selection button group 902, the user can designate whether or not to set the paper cassette as a cassette to be selected automatically. A cassette source for which "ON" is pressed becomes a cassette subjected to auto paper selection. A cassette for which "OFF" is pressed becomes a cassette not subjected to auto paper selection. When the user presses an OK button 903, setting ends, and the screen in FIG. 11 returns to one in FIG. 6A.

Table 2 below exemplifies data representing auto paper selection of paper cassettes and manual feed according to the embodiment.

After the end of cassette auto ON/OFF setting processing, data for one of cassette 1 to cassette 4 and manual feed in Table 2 is updated in correspondence with the setting. The data can be saved in either the memory 202 or DISK 211 of the controller 101. This data is used when automatically selecting a cassette. In the example of Table 2, it is set to use cassettes 1 and 2 in auto paper selection and not to use cassettes 3 and 4 in auto paper selection. Also, it is set to use manual feed in auto paper selection.

TABLE 2

| Cassette | State |
|---|---|
| Cassette 1 | ON |
| Cassette 2 | ON |
| Cassette 3 | OFF |
| Cassette 4 | OFF |
| Manual Feed | ON |

Figure 12:
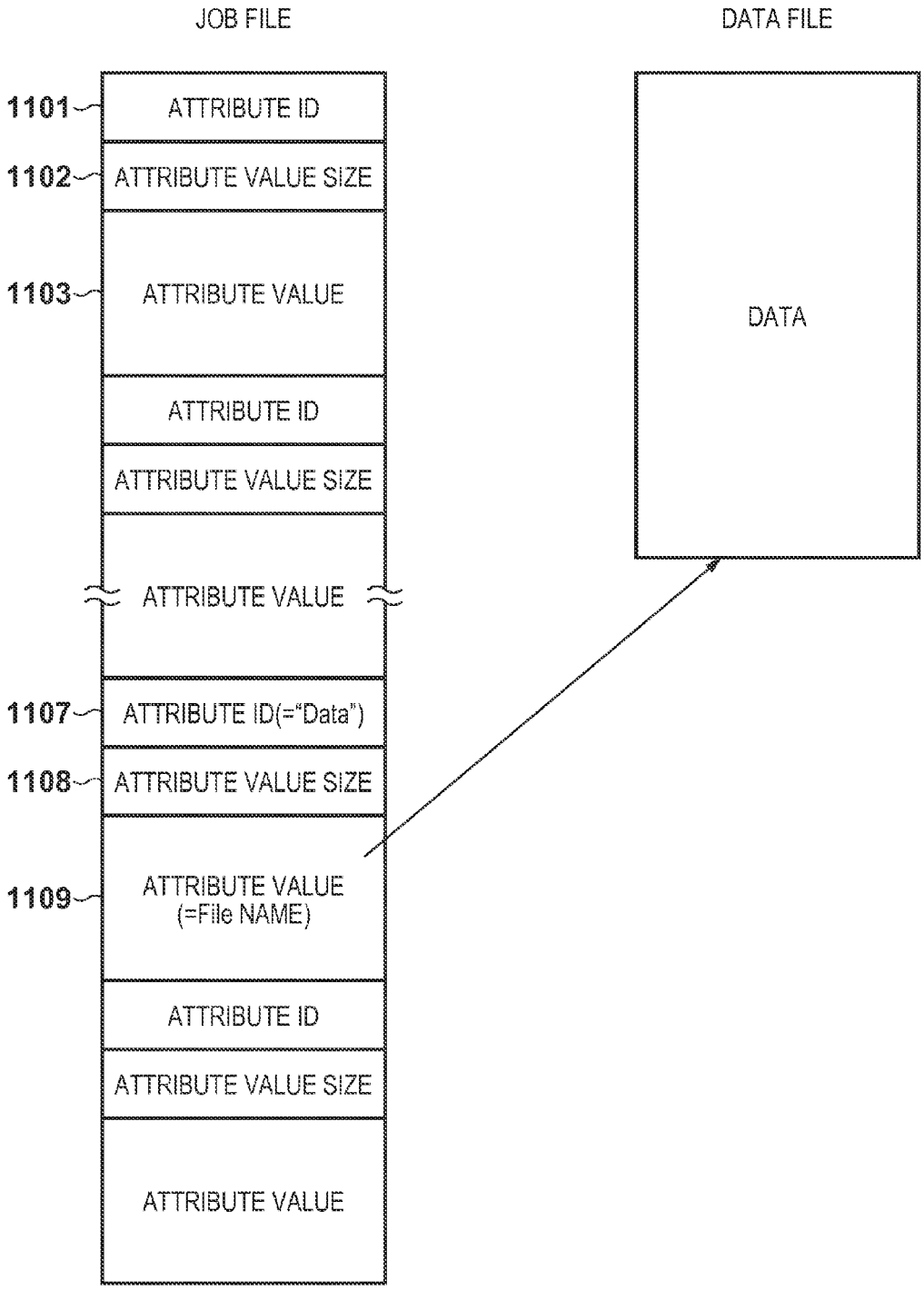
FIG. 12 is a view for explaining the data structure of a job in the embodiment.

FIG. 12 is a view for explaining the data structure of a job in the embodiment. An application in the device generates this data upon receiving an instruction to execute a job.

The entity of the job is represented by successively arranging a plurality of sets each of which has an attribute ID 1101, attribute value size 1102, and attribute value 1103. When a job contains data, it holds a value representing data as an attribute ID, the size of a file name as an attribute value size, and the file name of a file holding document data as an attribute value, as represented by 1107, 1108, and 1109. Each attribute value contains a data format (for example, PDL used), copy count, cassette source, paper size used in printing, and designation of finishing processing.

FIG. 13 is a table exemplifying the data attribute of a job according to the embodiment.

An attribute ID 1201 represents the ID number of an attribute. A type ID 1202 represents the type (size) of an ID such that "1" is an undefined length and "2" is 1 byte. A value 1203 represents a possible value and has a meaning as represented by a meaning 1204. The data attribute shown in FIG. 13 is merely an example, and various other attributes exist. A job is formed by setting these values in the attribute ID, attribute value size, and attribute value shown in FIG. 12.

Figure 14:
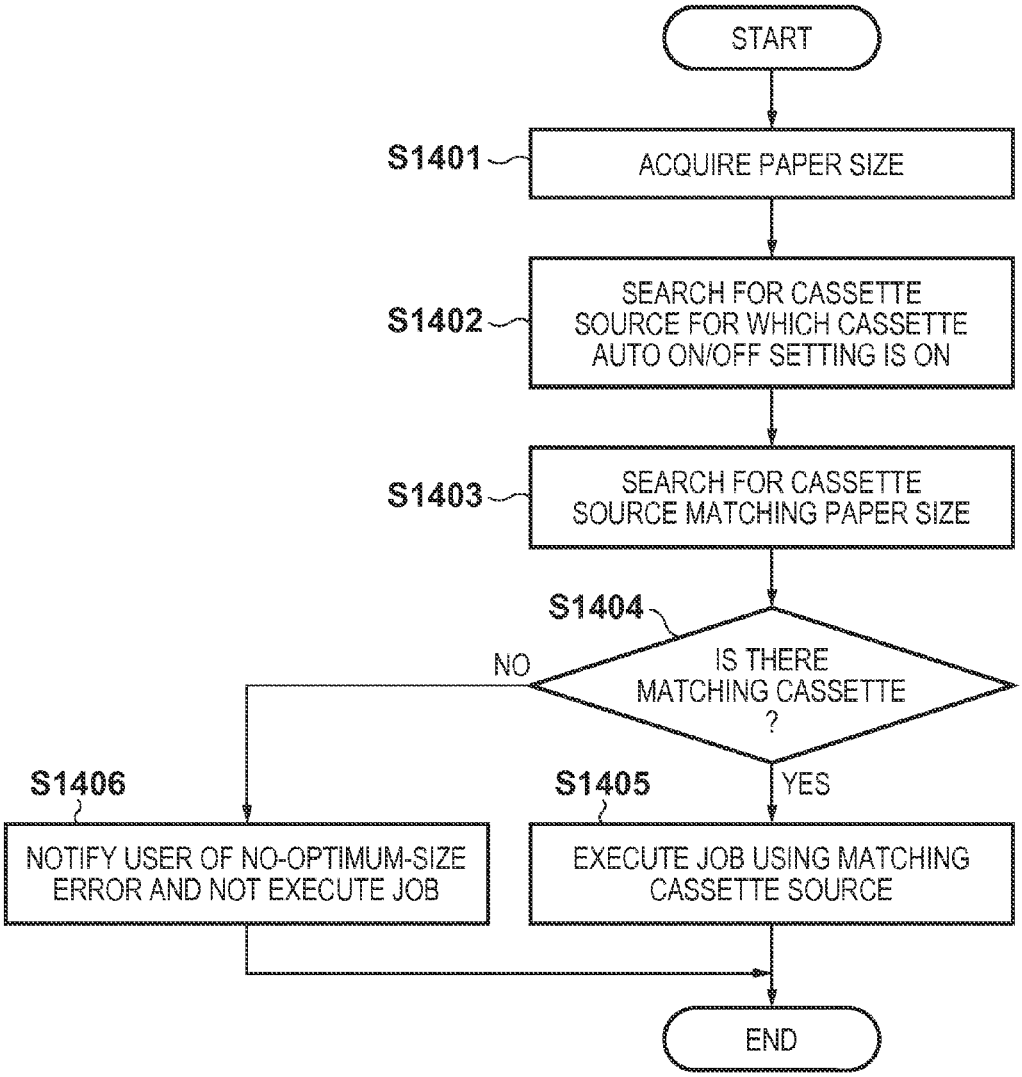
FIG. 14 is a flowchart for explaining an operation when the MFP according to the embodiment automatically selects a paper cassette for a job for which a paper size is designated.

FIG. 14 is a flowchart for explaining an operation when the MFP according to the embodiment automatically selects a paper cassette for a job for which a paper size is designated. This processing is implemented by executing a program stored in the memory 202 by the CPU 201 of the controller 101.

When auto paper selection processing starts, the CPU 201 acquires a paper size requested of processing from an attribute designated by the job in step S1401. The process advances to step S1402, and the CPU 201 searches for a paper cassette whose state is set to "ON" in Table 2, that is, which is used in auto paper selection. The process then advances to step S1403, and the CPU 201 determines whether a size coincident with the paper size acquired in step S1401 exists in paper sizes in Table 1 among paper cassettes whose states are "ON".

In step S1404, the CPU 201 determines whether there is a cassette source having a coincident size. If such a cassette source exists, the process advances to step S1405, and the CPU 201 executes the job using the coincident paper cassette source. If the CPU 201 determines in step S1404 that no such cassette source exists, the process advances to step S1406, and the CPU 201 notifies the user that there is no usable size, and then interrupts the job.

When the paper size acquired in step S1401 is B4 in the states of Table 1 and Table 2, the cassette search targets in Table 1 are 1 and 2. Paper of the paper size B4 is set for cassette 4 in Table 1, but the state of cassette 4 in Table 2 is "OFF". Thus, a paper cassette corresponding to the paper size B4 does not exist.

Figure 15A:
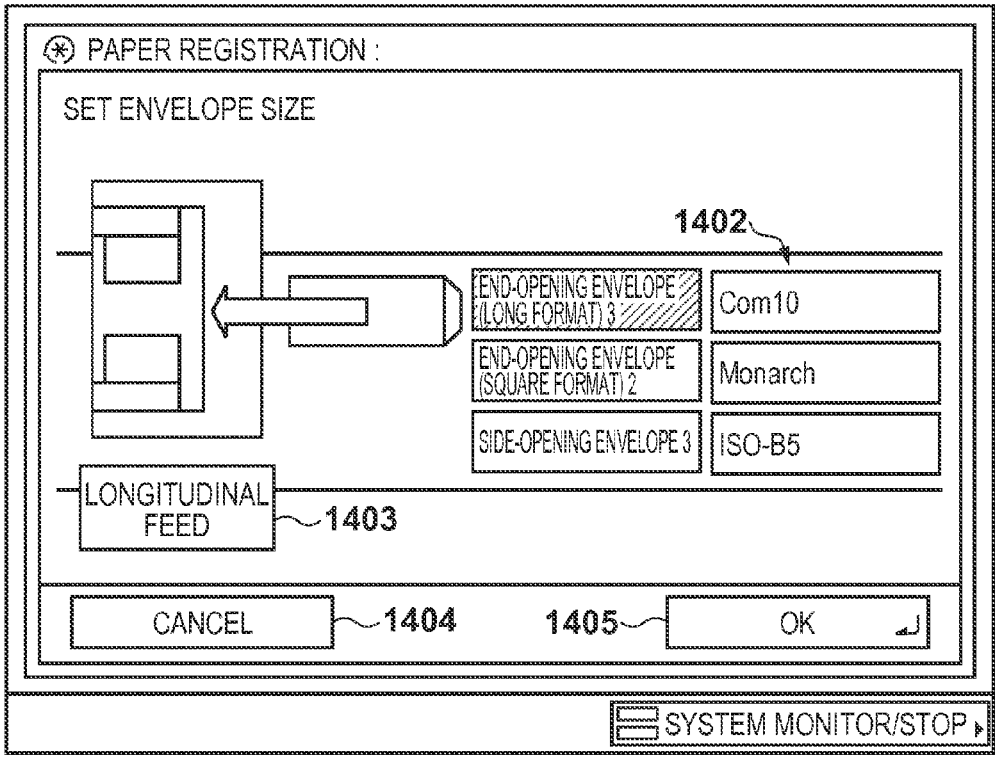
FIGS. 15A and 15B are views for explaining an envelope size setting method according to the embodiment.
Figure 15B:
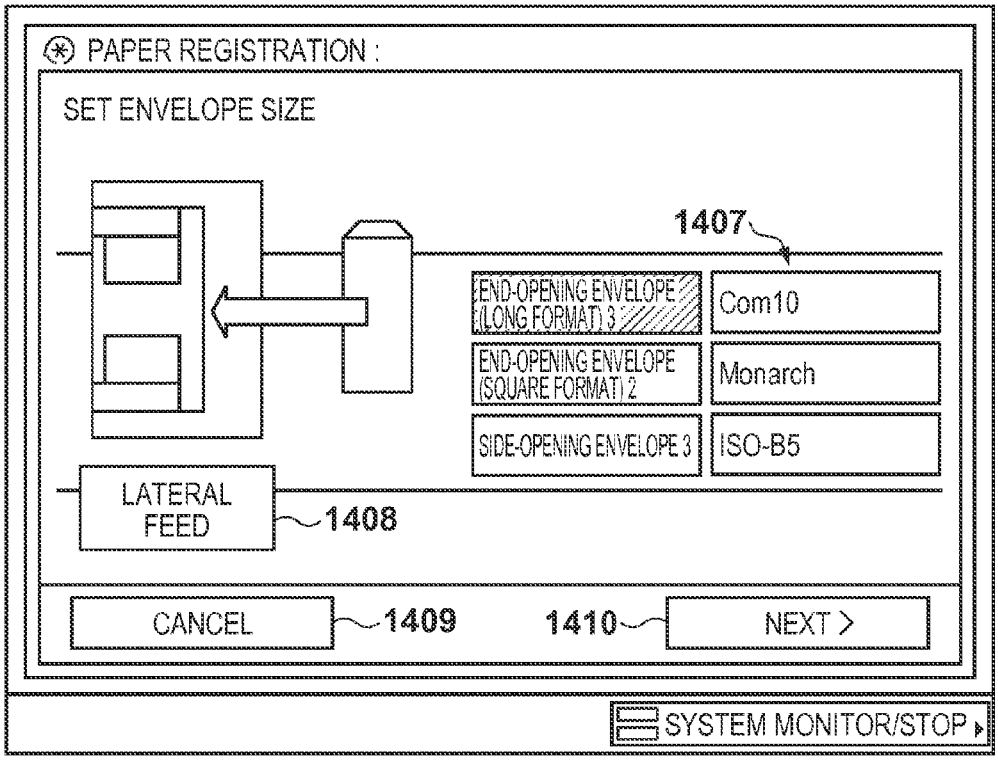
Figure 16:
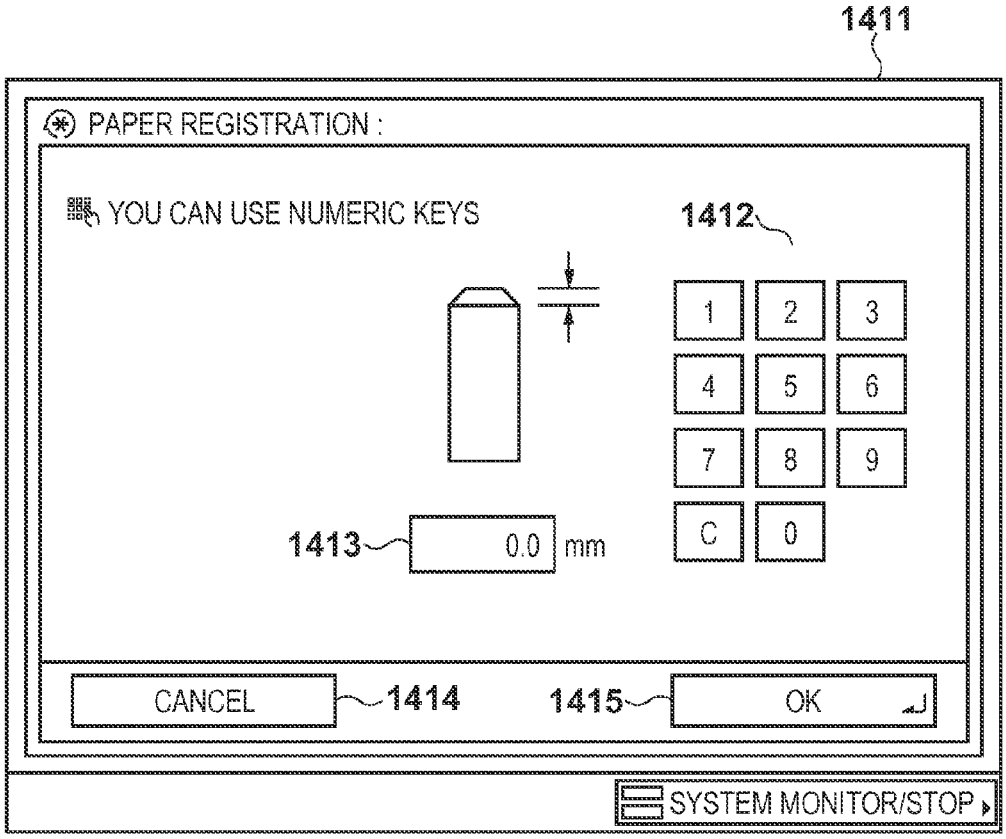
FIG. 16 is a view for explaining the envelope size setting method according to the embodiment.

FIGS. 15A, 15B, and 16 are views for explaining an envelope size setting method according to the embodiment.

When paper is set in the manual feed tray 304, the display unit 203 of the operation unit 106 displays the screen in FIG. 7A. If the user presses the envelope button 610 on this screen, a screen in FIG. 15A appears. This screen represents a case in which an envelope is conveyed parallel to its long edge (lateral feed or short-edge feed). The screen provides an envelope size setting button group 1402. By pressing a button in the button group 1402, the user can set an envelope size. In the button group 1402, "End-opening envelope (long format) 3" is selected as a default. The default changes depending on the destination. The default is "End-opening envelope (long format) 3" for Japan and "Com10" for overseas. The user presses a cancel button 1404 to cancel settings on the screen. When the user presses the cancel button 1404, the screen in FIG. 15A returns to one in FIG. 7A without any setting. The user presses an OK button 1405 to decide an envelope size. When the user presses the OK button 1405, an envelope size is set, and the screen in FIG. 15A returns to one in FIG. 7A. The CPU 201 saves the set contents in either the memory 202 or DISK 211. The user presses a longitudinal feed button 1403 to feed an envelope longitudinally (long-edge feed). When the user presses the longitudinal feed button 1403, a screen shown in FIG. 15B appears.

The screen in FIG. 15B represents a case in which an envelope is conveyed so that its long edge serves as the leading end in the conveyance direction (longitudinal feed or long-edge feed). The screen provides an envelope size setting button group 1407. By pressing a button in the button group 1407, the user can set an envelope size. In the button group 1407, "End-opening envelope (long format) 3" is selected as a default. The default changes depending on the destination. The user presses a cancel button 1409 to cancel settings on the screen. When the user presses the cancel button 1409, the screen in FIG. 15B returns to one in FIG. 7A without any setting. The user presses a lateral feed button 1408 to return to the screen in FIG. 15A. The user presses a Next button 1410 to decide an envelope size and enter a flap size. When the user presses the Next button 1410, a screen in FIG. 16 serving as an offset setting screen appears. This screen provides a numeric button group 1412, and the user can enter a flap size (margin width) in mm by using the numeric button group 1412. A display field 1413 displays the entered value. The user presses a cancel button 1414 to cancel settings on the screen. When the user presses the cancel button 1414, the screen in FIG. 16 returns to one in FIG. 15B. The user presses an OK button 1415 to decide a flap size. When the user presses the OK button 1415, a flap size is set, and the screen in FIG. 16 returns to one in FIG. 7A. The CPU 201 saves the set contents in either the memory 202 or DISK 211.

Table 3 below represents the data structure of the envelope size and flap size according to the embodiment. After the end of envelope setting processing, data in the flap size of Table 3 is updated. As described above, this data can be saved in either the memory 202 or DISK 211 of the controller 101.

TABLE 3

| Envelope Size | Flap Size |
|---|---|
| 1: COM10 | 0.0 mm |
| 2: Monarch | 0.0 mm |
| 3: ISO-C5 | 0.0 mm |
| 4: End-opening envelope (long format) 3 | 0.0 mm |
| 5: Side-opening envelope 3 | 0.0 mm |
| 6: End-opening envelope (square format) 2 | 0.0 mm |

Figure 17A:
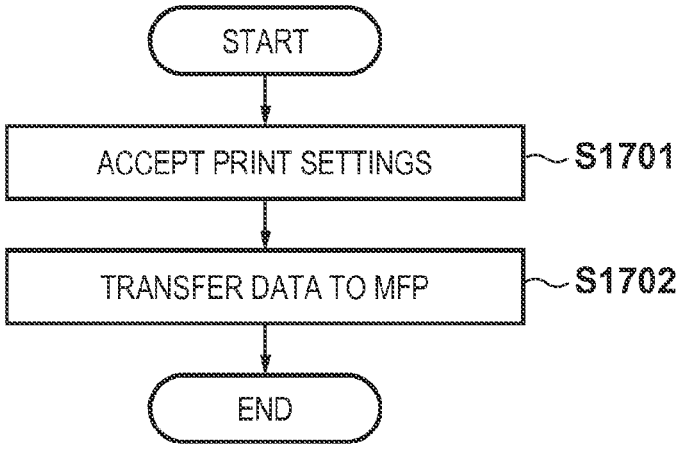
FIGS. 17A and 17B are flowcharts for explaining a printing sequence on an envelope by a PDL job according to the embodiment.
Figure 17B:
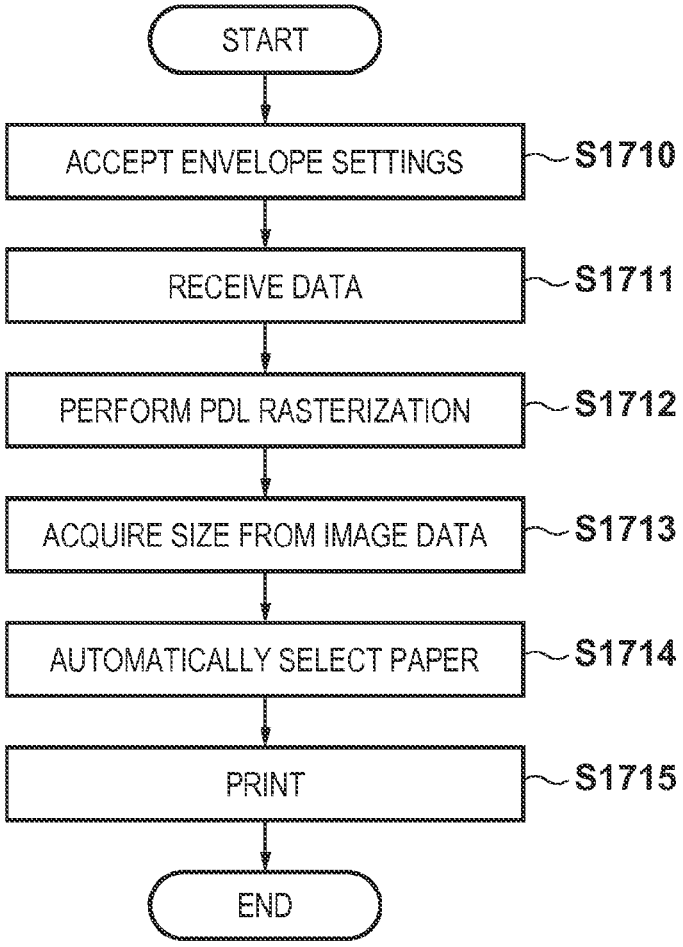

FIGS. 17A and 17B are flowcharts for explaining a printing sequence on an envelope by a PDL job according to the embodiment. FIG. 17A shows processing by the PC 107, and FIG. 17B shows processing by the MFP according to the embodiment. Note that the processing shown in the flowchart of FIG. 17A is implemented by reading out a program stored in the ROM (not shown) of the PC 107 and executing it by the CPU (not shown) of the PC 107. Also, the processing shown in the flowchart of FIG. 17B is implemented by reading out a program stored in the ROM 210 and executing it by the CPU 201.

First, in step S1701 of FIG. 17A, the PC 107 accepts the print settings of a PDL image output job from the user. The print setting contents include the copy count, paper size (envelope size in printing on an envelope), single-sided/double-sided, page output order, sort output, and stapling/no-stapling. Then, the process advances to step S1702, and the PC 107 accepts a print instruction from the user, and converts code data to be printed into so-called PDL data (print data) by using driver software installed in the PC 107. The PC 107 transfers the PDL data to the controller 101 via the network interface 105 together with the print setting parameters set in step S1501.

Next, processing in the MFP will be explained with reference to FIG. 17B.

Figure 19A:
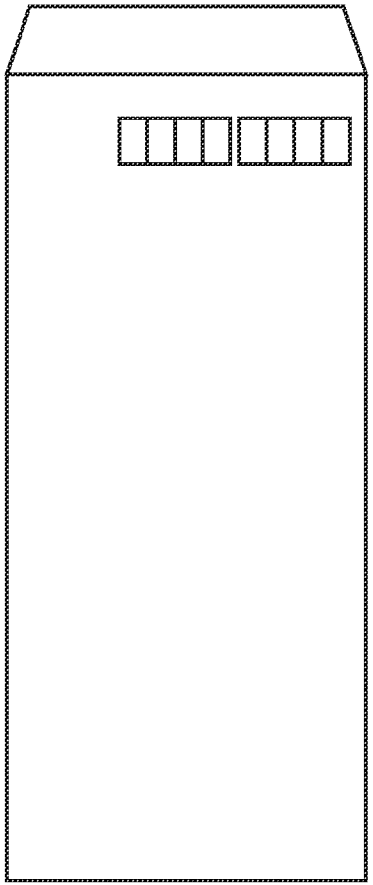
FIGS. 19A to 19C are views exemplifying an envelope size and printing on an envelope.

In step S1710, the CPU 201 detects that, for example, an envelope of End-opening envelope (long format) 3 in FIG. 19A is set in the manual feed tray 304. The user selects the longitudinal feed 1403 in FIG. 15A, and sets "End-opening envelope (long format) 3" as the envelope size in FIG. 15B. Further, the user enters, for example, "30.0" mm as the flap size, presses the OK button 1415 in FIG. 16, and sets plain paper on the screen of FIG. 8B. Then, the items in "Manual Feed" of Table 1 are updated as follows.

More specifically, in "Manual Feed", "End-opening envelope (long format) 3" is set as the paper size, "plain paper" is set as the paper type, and "longitudinal" is set as the feed. Also, the flap size of "End-opening envelope (long format) 3" in the envelope size of Table 3 is updated to 30.0 mm.

In step S1711, the CPU 201 receives the PDL data transferred from the PC 107 via the network interface 105. The process advances to step S1712, and the CPU 201 rasterizes the PDL data into image data based on the print setting parameters. Rasterization into image data is executed in the memory 202.

Figure 18:
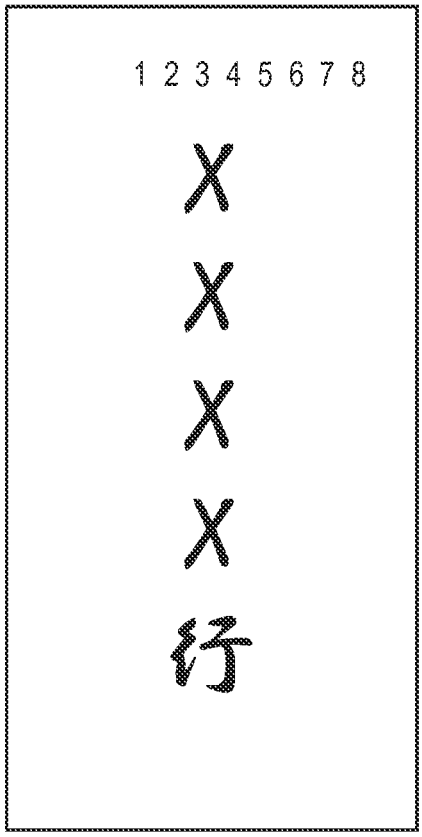
FIG. 18 is a view showing an image of image data rasterized in a memory when End-opening envelope (long format) 3 is set as the image size.

FIG. 18 is a view showing an image of image data rasterized in the memory when End-opening envelope (long format) 3 is set as the image size.

Figure 19B:
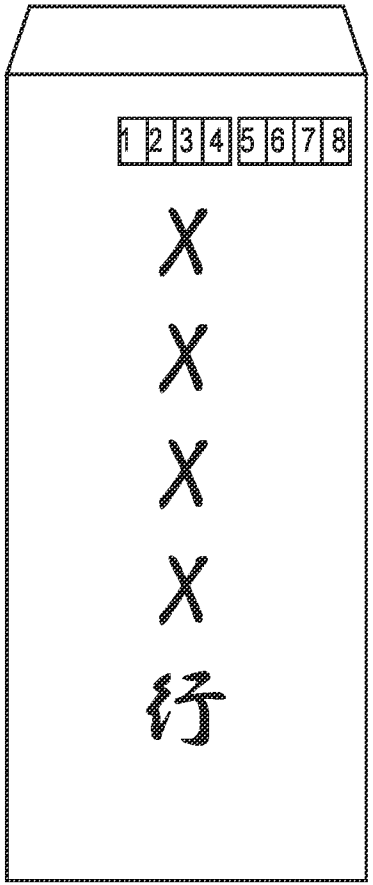
Figure 19C:
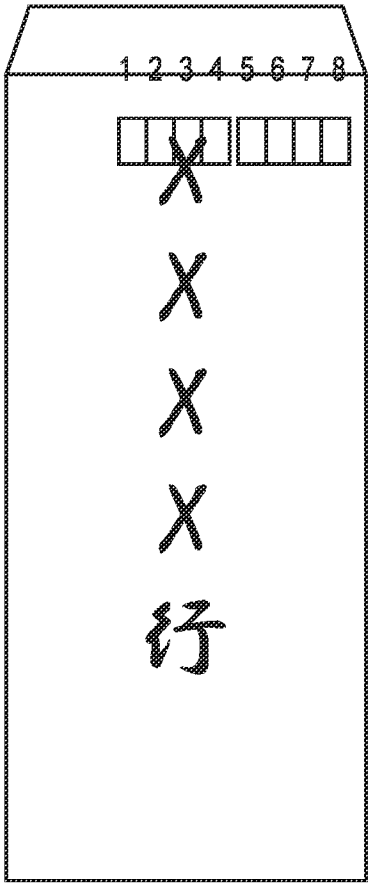

FIGS. 19A to 19C are views exemplifying an envelope size and printing on an envelope.

End-opening envelope (long format) 3 is defined by a size of 120 mm×235 mm. Image data of a size corresponding to this size is rasterized in the memory 202.

After that, the process advances to step S1713, and the CPU 201 of the controller 101 acquires a paper size designated by the PDL job from the attribute. The process advances to step S1714, and the controller 101 selects a paper source matching the acquired paper size. Since the designated paper size is End-opening envelope (long format) 3, a paper source in which an envelope of End-opening envelope (long format) 3 is set is selected, and a paper feed direction set for the paper source is acquired.

In the embodiment, End-opening envelope (long format) 3 is set for cassette 2 and manual feed. Short-edge feed (lateral feed direction) is set for cassette 2, and long-edge feed (longitudinal feed direction) is set for manual feed. Because the printing time is shorter for long-edge feed, the CPU 201 preferentially selects long-edge feed.

When manual feed is selected, the CPU 201 determines that the paper feed direction is longitudinal. The CPU 201 acquires a flap size corresponding to the envelope size from data managed in Table 3, and sets it as an offset amount. In this case, the flap size is set to 30.0 mm, so the offset amount also becomes 30.0 mm.

When the auto paper selection setting of manual feed is "OFF" in the auto paper selection setting represented in Table 2, no manual feed can be selected, and thus cassette 2 is selected. When cassette 2 is selected, the CPU 201 determines that the paper feed direction is lateral, sets the flap size to 0 mm, and sets no offset amount.

Then, the process advances to step S1715, and the CPU 201 controls the printer engine 103 to perform printing control based on image data. At this time, the image data is printed by shifting the output position of the image data by the offset amount. Accordingly, a printing result as shown in FIG. 19B can be obtained. If the output position of the image data is not shifted by the offset amount, the printing result becomes one as shown in FIG. 19C in which the positions of the address and postal code are misaligned.

As described above, according to the first embodiment, even when an envelope is set to convey it by long-edge feed, an appropriate image can be printed by shifting the image position in accordance with the flap size of the envelope. Even if a job of an image size not including the flap is input, an image can be printed at a proper position excluding the flap by changing the offset amount in accordance with information registered for a selected paper source. This is because, if an image rasterized in the memory 202 is aligned with the upper end of paper and printed on an envelope, similar to printing an image on paper other than an envelope, the image is not printed at a correct position owing to the presence of the flap of the envelope.

By conveying an envelope by long-edge feed under the above-described control, a larger number of sheets can be fed per unit time than by conveying envelopes by short-edge feed, and the time taken to print can be shortened. When conveying an envelope by long-edge feed and printing, even if the user creates an original image to be printed without taking account of the length of a flap, the image is correctly printed at a portion excluding the flap.

Second Embodiment

In the first embodiment described above, a flap size is set in advance in accordance with an envelope size. A flap size is acquired in accordance with the feed direction of paper set in a paper source, and is adjusted as an offset amount. However, the present invention is not limited to this. For example, it is also possible to set a flap size for paper set in each cassette source.

When the user presses an envelope button 610 in FIG. 7A in setting of paper information of a cassette source, a flap size input screen (not shown) appears in setting of longitudinal feed.

Table 4 below exemplifies data when paper of "End-opening envelope (long format) 3" is set in cassette 2 with longitudinal feed, and the flap size is set to 25.0 mm. This data can be saved in either a memory 202 or DISK 211 of a controller 101.

TABLE 4

| Cassette Source | Paper Size | X Size | Y Size | Paper Type | Flap Size |
|---|---|---|---|---|---|
| Cassette 1 | A4 | — | — | Plain paper | — |
| Cassette 2 | End-opening envelope (long format) 3 | — | — | Plain paper | 25.0 mm |
| Cassette 3 | User setting | 200 mm | 297 mm | Plain paper | — |
| Cassette 4 | B4 | — | — | Plain paper | — |
| Manual Feed | End-opening envelope (long format) 3 | — | — | Plain paper | 30.0 mm |

When a controller 101 controls a printer engine 103 to print image data, if paper set in a selected paper source has a flap size, the image data is shifted by an offset amount corresponding to the flap size and then printed.

Assume that "End-opening envelope (long format) 3" is set for a plurality of paper sources, that is, "cassette 2" and "manual feed", and longitudinal feed (long-edge feed) is set for both of them, as represented in Table 4. In this case, if flap sizes of "End-opening envelope (long format) 3" set for these paper sources are equal, the same printing result is obtained even by auto paper selection. However, when these flap sizes are different, as represented in Table 4, a printing result obtained when "cassette 2" is selected by auto paper selection and that obtained when "manual feed" is selected differ from each other. To solve this, the following control is executed.

A CPU 201 recognizes paper sources (for example, cassette 2 and manual feed) in which paper of a size (for example, End-opening envelope (long format) 3) designated by a job is set. The CPU 201 determines whether a plurality of paper sources in which paper having a flap size is set exist in the recognized paper sources. If there is only one paper having a flap size, the CPU 201 selects a paper source in which the paper is set. If the CPU 201 determines that there are a plurality of such paper sources, it determines whether flap sizes of paper in these paper sources are equal. If the CPU 201 determines that these flap sizes are equal, it automatically selects a paper source in accordance with predetermined paper source priority. For example, the CPU 201 controls to feed paper preferentially from a paper source having a short conveyance distance up to the image forming unit of the printer engine 103. In contrast, if the CPU 201 determines that these flap sizes are different, it presents, to the user, a plurality of recognized paper sources and information (paper size, paper type, and flap size) of paper set in each of these paper sources. Then, the CPU 201 selects, from the presented paper sources, a paper source designated by the user as a paper source to be used in printing. The CPU 201 feeds paper set in the selected paper source, shifts an image by a flap size set for the paper source, and prints it on the fed paper.

According to the second embodiment, different flap sizes can be set even for the same paper feed direction, like cassette 2 and manual feed. The image offset amount can be changed in accordance with the set flap size to correctly print an image. Hence, an image can be printed at a proper position without printing it on the flap, unlike FIG. 19C, thereby greatly improving user friendliness.

As described above, according to the second embodiment, even when paper having a flap, like an envelope, is set by long-edge feed, it is handled as paper of a standard size, and the auto paper selection function can be used similarly to an envelope set by short-edge feed. Regardless of which of short-edge feed and long-edge feed is used to set an envelope, the offset amount is changed in accordance with information registered for a selected paper source. An image can therefore be printed at an appropriate position without printing it on the flap.

Other Embodiments

In the above-described embodiments, print processing based on PDL data received from the PC 107 has been exemplified. However, the embodiments are also applicable to copy processing. In copying, a CPU 201 selects a paper source for use in accordance with a paper size accepted from the user via an operation unit 106, instead of designating a paper size by print data. In copying, an envelope may be placed on the original table with its flap opened. Thus, processing of shifting the image of a read original by a flap size set for a selected paper source may not be executed. Alternatively, in copying, the user may set in advance whether to shift the image of a read original by the flap size. In accordance with the setting, it may be decided whether to shift and print the image.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-264120, filed Dec. 1, 2011, which is hereby incorporated by reference herein in its entirety.

What is claimed is:

1. A printing apparatus comprising:

a plurality of sheet holding units configured to hold an envelope to be used in printing respectively;

a size setting unit configured to set, based on an instruction from a user, a size of an envelope to be held in each of the plurality of sheet holding units;

a flap length setting unit configured to set a length of a flap of an envelope to be held in each of the plurality of sheet holding units;

a selection unit configured to select, based on a size of an envelope which is designated in a print job and the size of an envelope set by the size setting unit, a sheet holding unit which holds an envelope of the designated size among the plurality of sheet holding units; and a printing unit configured to shift a position of an image in accordance with the length set by said flap length setting unit and print an image on an envelope fed from the sheet holding unit selected by the selection unit.

2. A method of controlling a printing apparatus which has a plurality of sheet holding units each of which holds an envelope to be used in printing, the method comprising:

setting, based on an instruction from a user, a size of an envelope to be held in each of the plurality of sheet holding units;

setting a length of a flap of an envelope to be held in each of the plurality of sheet holding units;

selecting, based on a size of an envelope which is designated in a print job and the set size of an envelope, a sheet holding unit which holds an envelope of the designated size among the plurality of sheet holding units; and shifting a position of an image in accordance with the set length and printing an image on an envelope fed from the selected sheet holding unit.

3. A non-transitory computer-readable storage medium storing a program for controlling a printing apparatus which has a plurality of sheet holding units each of which holds an envelope to be used in printing to perform a method, the method comprising:

setting, based on an instruction from a user, a size of an envelope to be held in each of the plurality of sheet holding units;

setting a length of a flap of an envelope to be held in each of the plurality of sheet holding units;

selecting, based on a size of an envelope which is designated in a print job and the set size of an envelope, a sheet holding unit which holds an envelope of the designated size among the plurality of sheet holding units; and shifting a position of an image in accordance with the set length and printing an image on an envelope fed from the selected sheet holding unit.

* * * * *